US006250787B1

(12) United States Patent
Matubara

(10) Patent No.: US 6,250,787 B1
(45) Date of Patent: Jun. 26, 2001

(54) VEHICLE LAMP FIXTURE

(75) Inventor: Masao Matubara, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/460,906

(22) Filed: Dec. 14, 1999

(30) Foreign Application Priority Data

Dec. 15, 1998 (JP) ..... 10-355279

(51) Int. Cl.[7] ..... F21V 5/00

(52) U.S. Cl. ..... 362/520; 362/374; 362/375; 362/267; 362/455; 362/456; 362/457; 362/459; 362/311

(58) Field of Search ..... 362/520, 374, 362/375, 267, 455, 456, 457, 459, 311

(56) References Cited

U.S. PATENT DOCUMENTS

| | | | | |
|---|---|---|---|---|
| 5,707,141 | * | 1/1998 | Yamamoto et al. | 362/305 |
| 5,765,942 | | 6/1998 | Shirai et al. . | |
| 6,019,492 | * | 2/2000 | Ikegaya et al. | 362/521 |
| 6,068,392 | * | 5/2000 | Ohtaki et al. | 362/546 |

* cited by examiner

*Primary Examiner*—Sandra O'Shea
*Assistant Examiner*—Ali Alavi
(74) *Attorney, Agent, or Firm*—Koda & Androlia

(57) ABSTRACT

In a lamp fixture for a vehicle lamp comprising a lamp body and a lens that has an outer edge portion curved backward and is mounted on the lamp body, a hook is formed on the outside wall of an attaching grooved portion of the lamp body, and a hook engaging portion is formed on the attaching leg portion of the lens, the front end surface of the hook engaging portion being substantially parallel to the rear surface of the outer edge portion of the lens so that once the hook engaging portion of the lens is engaged with the hook of the lamp body they are not easily separated.

6 Claims, 4 Drawing Sheets

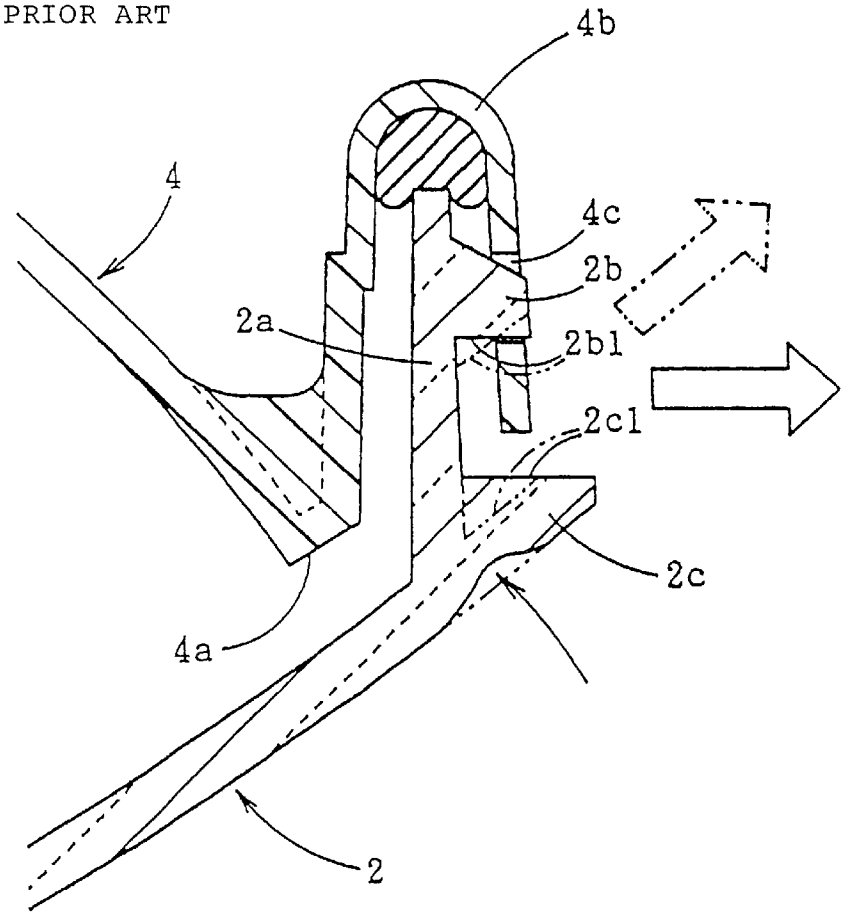
FIG. 4-(b)
PRIOR ART
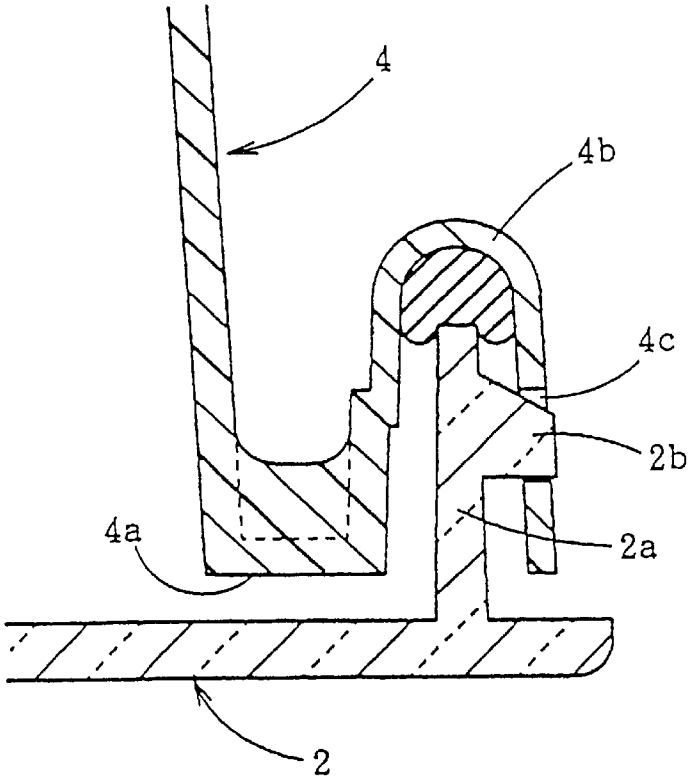
FIG. 4-(a)
PRIOR ART

VEHICLE LAMP FIXTURE

BACKGROUND OF THE INVENTION

1. Field of the Invention

The present invention relates to a vehicle lamp fixture that includes a so-called wraparound lens and more particularly to a structure for mounting such a lens to a lamp body.

2. Prior Art

FIG. 4(*a*) shows a generally known prior art structure for mounting a lens to a lamp body.

In this vehicle lamp fixture, an attaching leg portion 2*a* formed at a location near the outer edge of a lens 2 is inserted into an attaching grooved portion 4*b* formed in a front end open outer edge portion 4*a* of a lamp body 4, so that the attaching leg portion 2*a* and the attaching grooved portion 4*b* are brought into a hook-engagement. This hook-engagement is obtained by engaging a hook 2*b* formed on the outside wall surface of an attaching leg portion 2*a* with a hook engaging hole 4*c* formed in the attaching grooved portion 4*b*.

However, this prior art structure causes problems when the hook-engaging structure is employed in a vehicle lamp fixture in which an end portion of the lens is curved so as to wrap around the rear side thereof as shown in FIG. 4(*b*).

More specifically, in this type of lens, a rear wall surface 2*c*1 of a lens outer edge portion 2*c*, which is located further toward the outside of the attaching leg portion 2*a*, is formed parallel to or so as to expand toward the outside with respect to the distance between the rear wall surface 2*c*1 and the front end surface 2*b*1 of the hook 2*b*. This is due to the structure of a die for forming the lens so that any undercut can be prevented from occurring, making it possible to use a slide die. In order to accomplish a reliable hook-engagement, it is also necessary to form the front end surface 2*b* 1 of the hook 2*b* so as to engage with the front end surface of the hook engaging hole 4*c* at an angle equal to or greater than a right angle.

As a result, a secure hook engaging function is demanded, the lens outer edge portion 2*c* needs to have a trapezoidal cross-sectional shape as shown by the solid line in FIG. 4(*b*) with the base end portion thereof made large in thickness. However, this causes a surface sinking problem, that reduces the quality of appearance of the lamp fixture.

On the other hand, when the lens outer edge portion 2*c* is designed to have substantially a constant thickness so as to prevent the surface sinking in the lens 2 as shown by the chain double-dashed line in FIG. 4(*b*), then another problem occurs. The front end surface 2*b*1 of the hook 2*b* abuts diagonally on the front wall surface of the hook engaging hole 4*c*; and the hook 2*b* tends to be easily separated from the hook engaging hole 4*c*. Thus, a sufficient hook-engagement is hindered.

SUMMARY OF THE INVENTION

The present invention is made in view of the above problems. The object of the present invention is that in a vehicle lamp fixture that includes a lens having its end portion curved so as to wrap around the rear side thereof, the lamp fixture provides a sufficient hook engaging function when the lens is mounted to a lamp body without deteriorating the quality of appearance of the lamp fixture.

In addition, in the present invention, the above object is accomplished by a lamp fixture which is obtained by way of devising a hook engaging structure.

The above objects of the present invention are accomplished by a unique structure for a vehicle lamp fixture which comprises a lens, which is formed curved so that an end portion thereof wraps around to a rear side thereof, and a lamp body, which is disposed on the rear side of this lens; and the lens is provided with an attaching leg portion formed at a location near the outer edge of the lens so as to extend to the rear, and the lamp body is provided with an attaching grooved portion at the front end open outer edge portion of the lamp body so that the attaching leg portion of the lens is inserted in the attaching grooved portion of the lamp body; and in the present invention:

- a hook is formed on an outside wall surface of the attaching grooved portion which is located at the rear of (or behind) the end portion of the lens,
- a hook engaging portion which engages with the hook is formed on the outside wall surface of the attaching leg portion of the lamp body, and
- the front end surface of the hook engaging portion is formed parallel to or so as to expand toward the outside with respect to the distance between the front end surface of the hook and surface of the outer edge portion of the lens located further outside than the attaching leg portion.

The "edge portion" may be any edge located at the top, bottom, left and right edge portions of the lens. In addition, such an "edge portion" may be a single location, and it is also possible to provide a plurality of edge portions.

As seen from the above, in the vehicle lamp fixture according to the present invention: a hook is formed on the outside wall surface of the attaching grooved portion of the lamp body, the attaching grooved portion being located at the rear of (or behind) the lens end portion that is formed curved so as to wrap around to the rear side; a hook engaging portion which engages with the hook is formed on the outside wall surface of the attaching leg portion of the lens; and the front end surface of the hook engaging portion is formed parallel to or so as to expand toward the outside with respect to the distance between the front end surface of the hook and surface of the lens outer edge portion. As a result, the following function and effects can be achieved.

Since the front end surface of the hook engaging portion is formed parallel to or so as to expand toward the outside with respect to the distance between the front end surface of the hook and surface of the lens outer edge portion, the hook engaging portion has a return angle. Therefore, once the hook is engaged with the hook engaging portion by inserting the attaching leg portion of the lens into the attaching grooved portion of the lamp body, such an engagement can be maintained so that the attaching leg portion of the lens and the attaching grooved portion of the lamp body are not easily separated.

A die for forming the lens of the present invention needs to be a slide die so as to form the hook engaging portion. In this regard, since the front end surface of the hook engaging portion is formed parallel to or so as to expand toward the outside with respect to the distance between the front end surface of the hook and surface of the lens outer edge portion, there is no need to form the lens outer edge portion in a trapezoidal cross-sectional shape as in the prior art to prevent undercut. Therefore, since the base end of the end portion of the lens is not thick, it is possible to prevent or minimize any surface sinking of the lens, and it is also possible to prevent damage to the appearance of the lamp fixture.

In other words, according to the present invention, which is for a vehicle lamp fixture in which the end portion of the lens is formed curved so as to wrap around to the rear side, a hook engagement function during attachment of the lens to the lamp body is not suffered, and the appearance quality of the lamp fixture is not deteriorated.

In the structure described above, the hook is formed on the outside wall surface of the attaching grooved portion of the lamp body. However, the hook may be formed at the tip portion of a protruding piece which extends forward from the outside wall front end surface of the attaching grooved portion. In this case, the portion near both sides of the protruding piece in the outside wall front end surface of the attaching grooved portion can be formed in a concave shape. With this shaping, it is possible to easily engage the hook with the hook engaging portion and to make it difficult for these members to separate from each other once they are engaged, because the protruding piece is flexed by its elastic deformation when the attaching leg portion is inserted into the attaching grooved portion.

Also, in the above structure, the thickness of the lens outer edge portion can be set to an appropriate value that prevents or minimizes the surface sinking in the lens. Furthermore, by way of setting this thickness to a value that is substantially the same as the thickness of an area of the lens that is located inside the attaching leg portion, it is possible to prevent a large difference in the appearance of the lens at the inside and outside of the attaching leg portion. As a result, the quality of appearance of the lamp fixture can be improved.

BRIEF DESCRIPTION OF THE DRAWINGS

FIGS. 4(*a*) and 4(*b*) show conventional examples similar to FIG. 2.

DETAILED DESCRIPTION OF THE PREFERRED EMBODIMENTS

One embodiment of the present invention will be described below with reference to the accompanying drawings.

Figure 1:
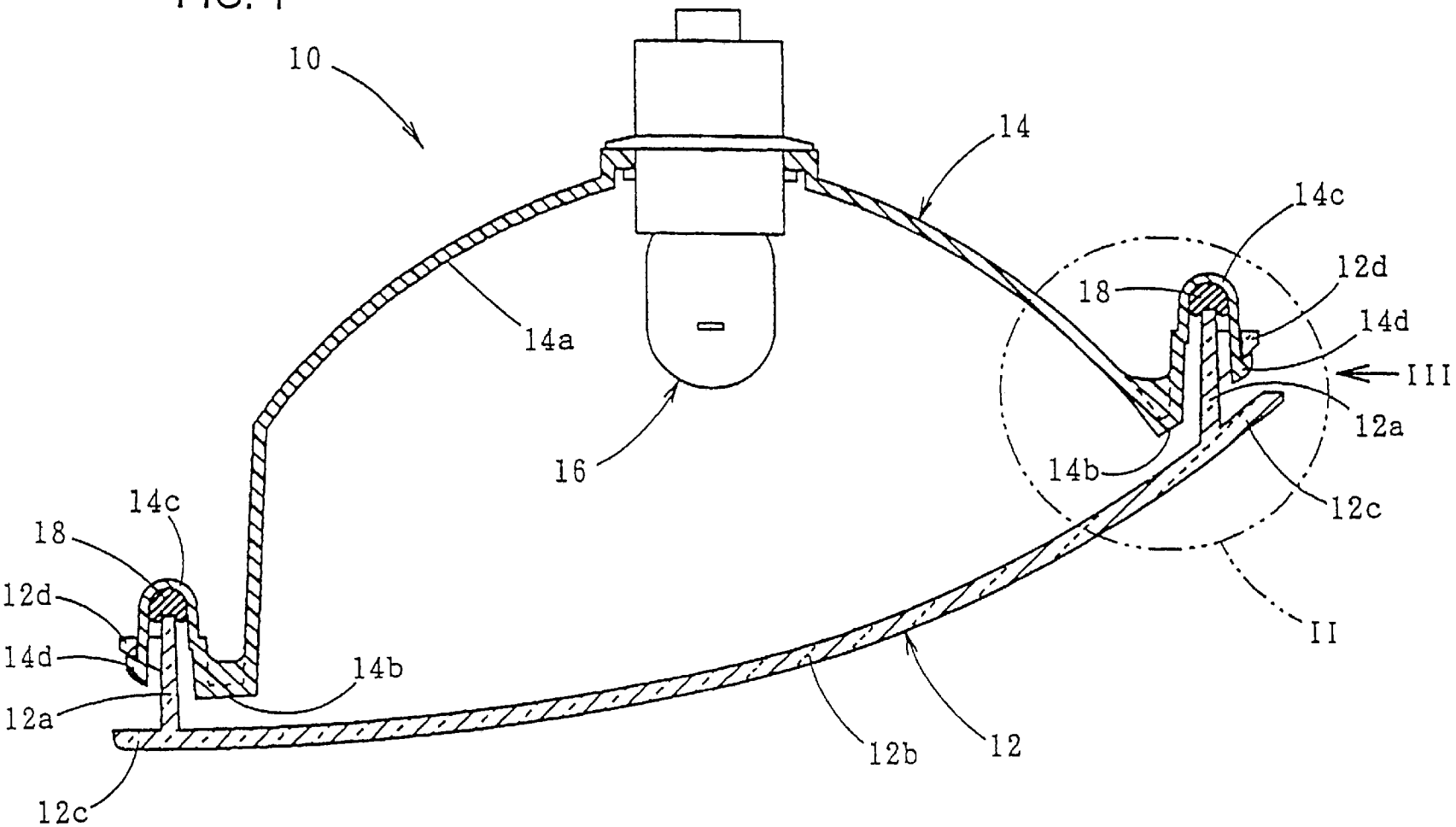
FIG. 1 is a horizontal cross-section view of a vehicle lamp fixture according to one embodiment of the present invention.

The vehicle lamp fixture 10 shown in FIG. 1 as an example is a tail lamp mounted at the right rear end portion of a vehicle body and is comprised of a lens 12, a lamp body 14 and a light-source bulb 16. The lens 12 is formed curved so that its right end portion wraps around toward the rear side of the lens ("rear side" used here and hereinafter being with respect to the lamp fixture, and therefore, it refers to the front side of a vehicle body on which the lamp fixture is mounted). The lamp body 14 is provided so as to be located on the rear side of the lens 12, and the light-source bulb 16 is attached to the rear-most portion of this lamp body 14.

An attaching leg portion 12*a* that extends to the rear side of the lens 12 is formed at a location near the outer edge portion of the lens 12 for the entire perimeter of the lens 12. The lens 12 comprises a lens general portion 12*b* located inside the attaching leg portion 12*a* and a lens outer edge portion 12*c* located outside the attaching leg portion 12*a*. The lens general portion 12*b* and the lens outer edge portion 12*c* are substantially the same in thickness.

A reflective surface 14*a* which reflects the light from the light-source bulb 16 is formed on the lamp body 14. At the front end open outer edge portion 14*b* that surrounds the reflective surface 14*a* is provided an attaching grooved portion 14*c*. The attaching leg portion 12*a* of the lens 12 is inserted into this attaching grooved portion 14*c* of the lamp body 14. The lens 12 and the lamp body 14 are fixed together when the attaching leg portion 12*a* is inserted into the attaching grooved portion 14*c*, into which a gasket 18 has been placed, and these members put into a hook-engagement at a plurality of locations.

Figure 2:
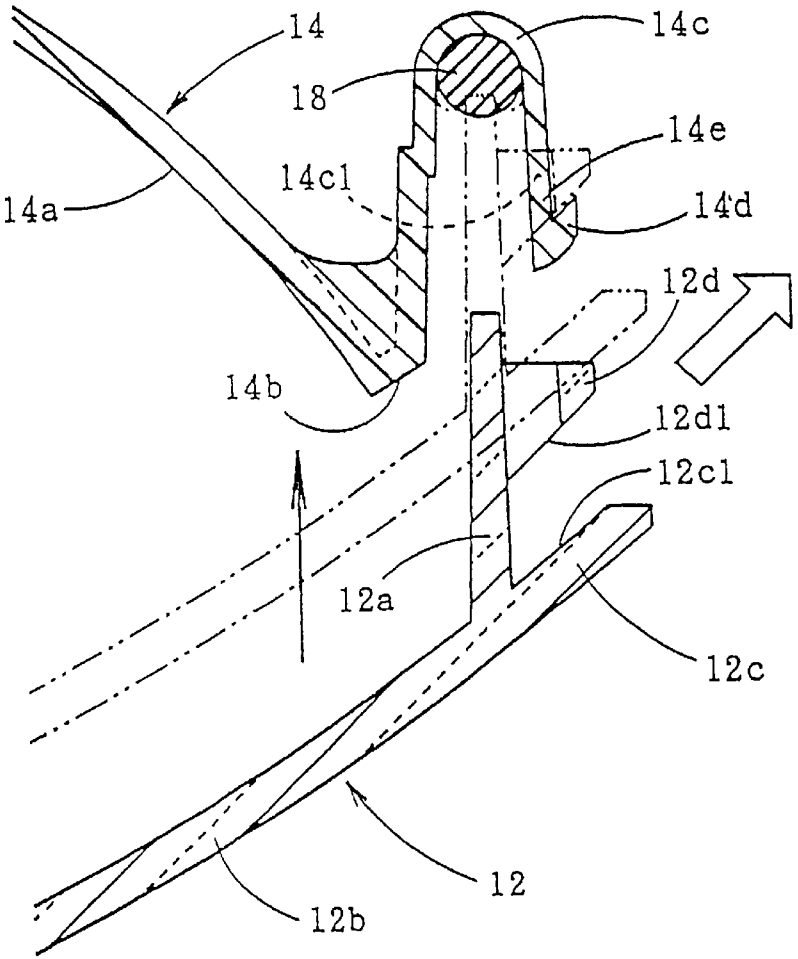
FIG. 2 is an exploded detailed illustration of the portion II in FIG. 1.
Figure 3:
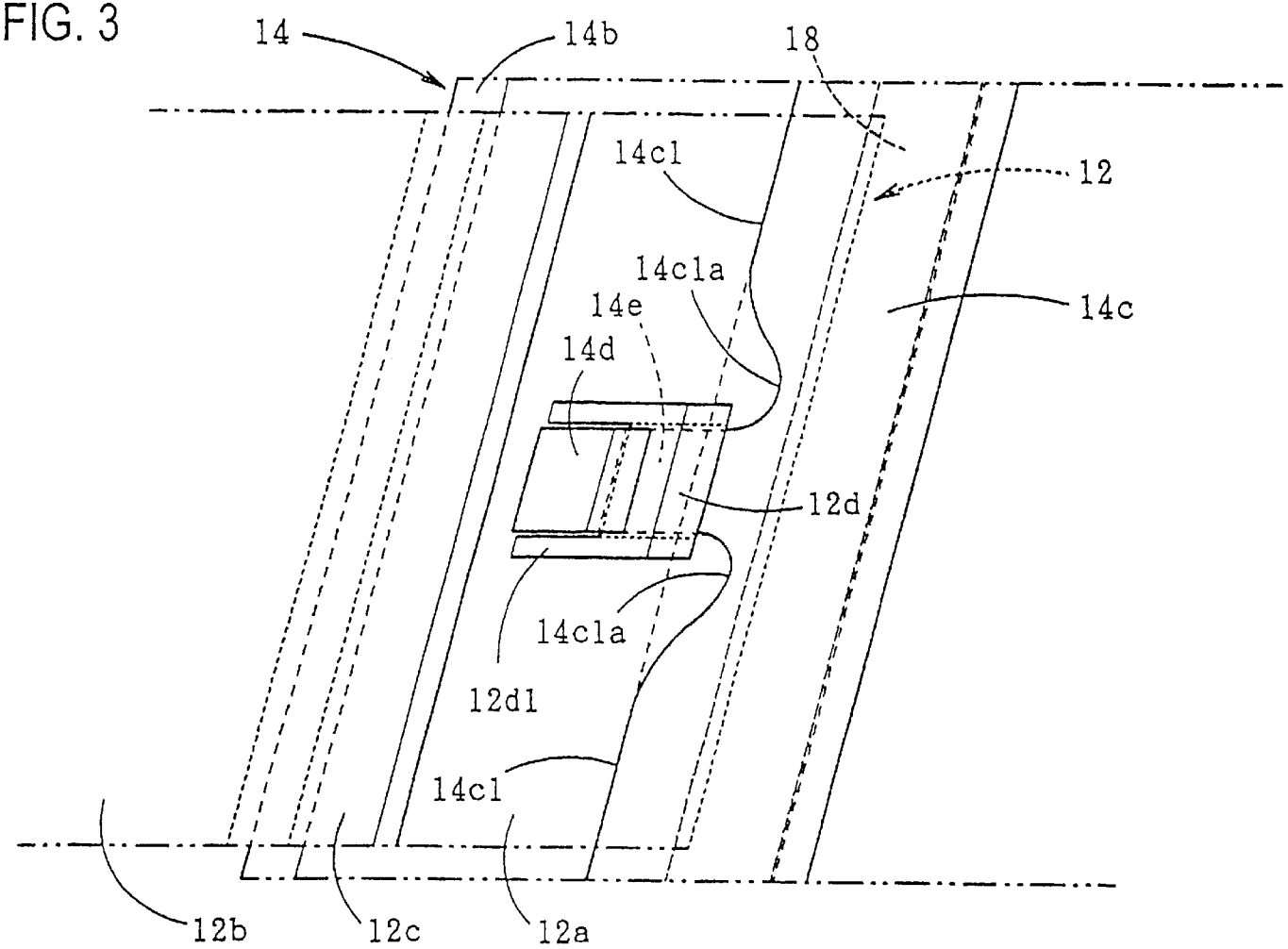
FIG. 3 is a detailed view taken in the direction of an arrow III in FIG. 1.

FIG. 2 is an exploded detailed view of area II in FIG. 1. FIG. 3 is a detailed view of FIG. 1 as viewed in a direction indicated by an arrow III.

A hook 14*d* is formed on the outside wall surface of the attaching grooved portion 14*c* of the lamp body 14 so as to be located at the rear of (or behind) the end portion of the lens 12. Meanwhile, a hook engaging portion 12*d* which engages with the hook 14*d* is formed on the outside wall surface of the attaching leg portion 12*a*. This hook engaging portion 12*d* is formed in a gate shape, with the front end surface thereof 12*d*1 formed substantially parallel (or to expand slightly to the outside) with respect to the rear wall surface 12*c*1 of the lens outer edge portion 12*c*.

A die which is for forming the lens 12 has a slide die so as to form the hook engaging portion 12*d*. The direction of extraction of this slide die is set to the direction shown by the white arrow (i.e., the same direction as the front end surface 12*d*1 of the hook engaging portion 12*d*) in FIG. 2.

The hook 14*d* is formed at the tip portion of a protruding piece 14*e* that extends and protrudes forward from the outside front wall surface 14*c*1 of the attaching grooved portion 14*c*. The hook 14*d* is formed so that the front end surface thereof is curved inclining to the rear, and the rear end surface thereof is flat and has a rear inclination angle that is substantially the same as the front end surface 12*d*1 of the hook engaging portion 12*d*. The portions 14*c*1 a near both sides of the protruding piece 14*e* in the outside wall front end surface 14*c*1 of the attaching grooved portion 14*c* are in a concave shape having a smooth curved line.

A similar hook engaging structure is employed in other hook engaging locations as well in addition to the hook engaging locations shown in the drawing. However, in other hook engaging locations, the front end surface 12*d*1 of the hook engaging portion 12*d* and the rear wall surface 12*c*1 of the lens outer edge portion 12*c* expand toward the outside, because the rear inclination angle of the lens outer edge portion 12*c* are smaller in those locations.

As detailed above, in the vehicle lamp fixture 10 according to the shown embodiment, the front end surface 12*d*1 of each hook engaging portion 12*d* formed at a plurality of locations of the lens 12 is formed parallel to or so as to expand toward the outside with respect to the distance between the front end surface 12*d*1 and the rear wall surface 12*c*1 of the lens outer edge portion 12*c*. As a result, the hook engaging portion 12*d* may have a return angle. Therefore, once the hook 14*d* is engaged with the hook engaging portion 12*d* by inserting the attaching leg portion 12*a* of the lens 12 into the attaching grooved portion 14*c* of the lamp body 14, such an engagement is reliably maintained, and both members are not easily separated.

In addition, the front end surface 12*d*1 of each hook engaging portion 12*d* is formed parallel to or so as to expand toward the outside with respect to the distance between the front end surface 12*d*1 and the rear wall surface 12*c*1 of the lens outside edge portion 12*c*. As a result, the lens outer edge portion 12*c* does not need to be formed in a trapezoidal cross-sectional shape so as to prevent undercut as in the past, and a slide die of a die for forming the lens 12 can be made. Therefore, since the base end portion of the lens outer edge portion 12*c* is not thick, it is possible to prevent or minimize sinking of the surface of the lens 12, and it is also possible to prevent damage to the quality of appearance of the lamp fixture.

As seen from the above, according to the shown embodiment, the vehicle lamp fixture wherein the lens end portion is curved so as to wrap around to the rear side thereof is able to provide a sufficient hook engaging function during attachment of the lens 12 and the lamp body 14 without damaging the quality of appearance of the lamp fixture.

In the shown embodiment, the hook 14*d* is formed at the tip portion of the protruding piece 14*e* that extends so as to protrude forward from the outside wall front end surface 14*c*1 of the attaching grooved portion 14*c*. Also, the portion 14*c*1 a near both sides of the protruding piece 14*e* in the outside wall front end surface 14*c*1 of the attaching grooved portion 14*c* is formed in a concave shape. Accordingly, the protruding piece 14*e* is flexed by elastic deformation when inserting the attaching leg portion 12*a* into the attaching grooved portion 14*c*, and it is possible to easily engage the hook 14*d* with the hook engaging portion 12*d* and to make it difficult for both members to be separated from each other once engaged.

Further, the thickness of the lens outer edge portion 12*c* is set to a value that is substantially the same as the thickness of the lens general portion 12*b* which is located on the inner side of the attaching leg portion 12*a*. This structure can prevent a large difference in the appearance of the lens 12 at the inner side and the outer side of the attaching leg portion 12*a*. As a result, the quality of appearance of the lamp fixture can be improved.

In the above-described embodiment, the vehicle lamp fixture 10 is a tail lamp. Operation and effect similar to that of the foregoing embodiment may be achieved in a vehicle lamp fixture for other signal lamps and head lamps and the like as well by way of employing a structure similar to that in the foregoing embodiment

What is claimed is:

1. A vehicle lamp fixture comprising a lens curved so that an end portion thereof extends around to a rear side thereof and a lamp body disposed on a rear side of said lens, wherein:

an attaching leg portion is formed at a location near an outer edge of said lens so as to extend to a rear thereof, and an attaching grooved portion into which said attaching leg portion is inserted is formed in a front end open outer edge portion of said lamp body, said lamp fixture further comprising:

a hook is formed on an outside wall surface of said attaching grooved portion located on a rear side of said outer edge portion of said lens and a hook engaging portion which engages said hook is formed on an outside wall surface of said attaching leg portion, and a front end surface of said lamp engaging portion is formed so as to be substantially parallel to a rear surface of said outer edge portion of said lens located further outside than said attaching leg portion.

2. The vehicle lamp fixture according to claim 1, wherein:

said hook is formed at a tip portion of a protruding piece that protrudes forward from an outside wall front end surface of said attaching grooved portion, and a portion near both sides of said protruding piece on said outside wall front end surface of said attaching grooved portion is formed in a concave shape.

3. The vehicle lamp fixture according to claim 1, wherein:

a thickness of said outer edge portion of said lens is substantially the same as a thickness of a general lens portion which is located further inside than said attaching leg portion.

4. The vehicle lamp fixture according to claim 2, wherein:

a thickness of said outer edge portion of said lens is substantially the same as a thickness of a general lens portion which is located further inside than said attaching leg portion.

5. The vehicle lamp fixture according to claim 1, wherein:

the hook engaging portion is formed in a gate shape.

6. The vehicle lamp fixture according to claim 1, wherein:

the hook is formed so that the front end surface thereof is curved inclining to the rear, and the rear end surface thereof is flat and has a rear inclination angle that is substantially the same as the front end surface of the hook engaging portion.

* * * * *